US005579023A

United States Patent [19]

Blaese

[11] Patent Number: 5,579,023

[45] Date of Patent: Nov. 26, 1996

[54] ROTATABLE ANTENNA AND INTEGRAL, SHIELDED IMPEDANCE MATCHING NETWORK

[76] Inventor: Herbert R. Blaese, 3314 Olcott Ave., Chicago, Ill. 60634

[21] Appl. No.: 436,153

[22] Filed: May 8, 1995

[51] Int. Cl.[6] ..... H01Q 1/24; H01Q 1/50

[52] U.S. Cl. ..... 343/851; 343/702; 343/860; 343/882; 343/900; 343/906

[58] Field of Search ..... 343/702, 900, 343/905, 906, 888, 715, 749, 850, 851, 860, 882; H01Q 1/24, 9/00

[56] References Cited

U.S. PATENT DOCUMENTS

| | | | |
|---|---|---|---|
| 2,514,167 | 7/1950 | Scott | 343/900 |
| 3,798,654 | 3/1974 | Martino et al. | 343/745 |
| 5,218,369 | 6/1993 | Jennings | 343/702 |
| 5,218,370 | 6/1993 | Blaese | 343/702 |
| 5,403,197 | 4/1995 | Ernst et al. | 343/702 |

*Primary Examiner*—Michael C. Wimer
*Attorney, Agent, or Firm*—Gerstman, Ellis & McMillin, Ltd.

[57] ABSTRACT

A rotatable antenna is disclosed in which a radiator and matching network comprise a contiguous electrically conductive spring wire. The matching network comprises a coil extending generally perpendicular to the radiator. A 50 ohm coaxial cable has its ground conductor electrically connected to an electrically conductive sleeve which overlies the coil while the main conductor of the coaxial cable is tapped to the coil so that the matching network substantially matches the radiator impedance to the transmission line impedance. The matching network is rotatable with respect to a mounting member so that the radiator becomes rotatable about an axis that is generally perpendicular to the radiator.

11 Claims, 2 Drawing Sheets

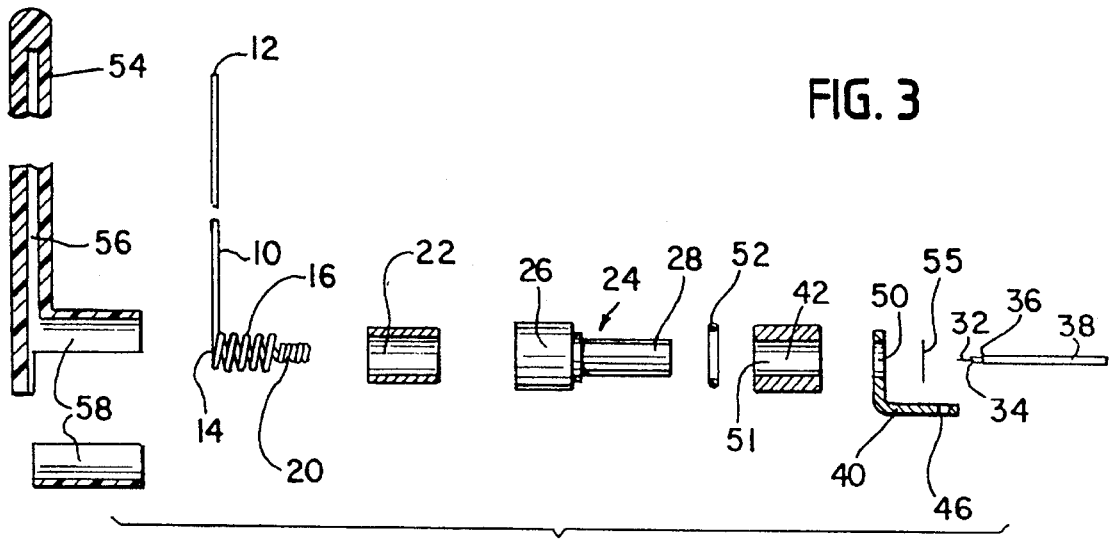
FIG. 3
FIG. 4
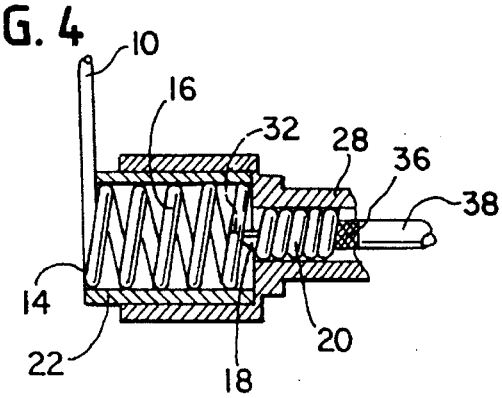
FIG. 5
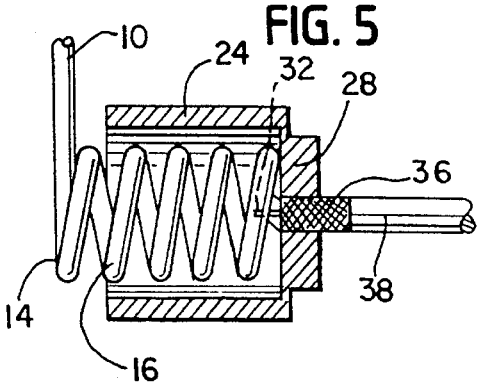
FIG. 6
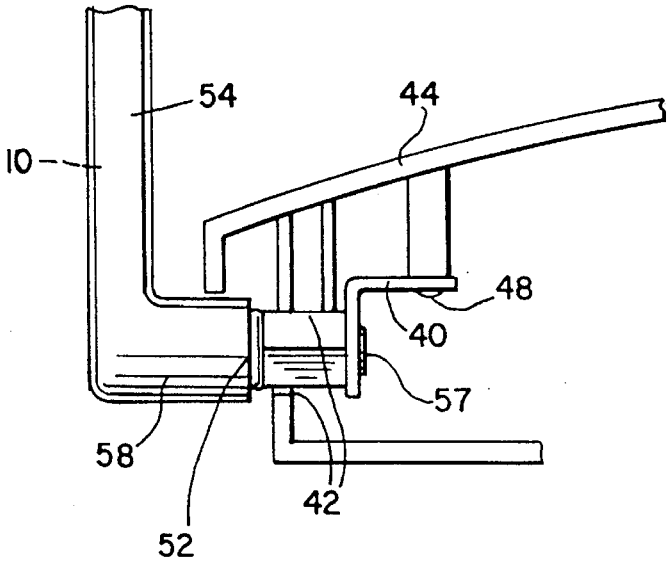

ROTATABLE ANTENNA AND INTEGRAL, SHIELDED IMPEDANCE MATCHING NETWORK

FIELD OF THE INVENTION

The present invention concerns a novel antenna, and, more particularly, an antenna that can be mounted and is rotatable about an axis generally perpendicular to the radiator.

BACKGROUND OF THE INVENTION

There is a need for an antenna that does not require a matching network within the device to which it is attached. For example, it is often desirable for the matching network of a half wave antenna to be external to the circuit board of the transmitter/receiver to which the antenna is connected. To this end, sleeve antennas are sometimes used in the prior art. Such sleeve antennas are center fed, generally avoiding the need for a matching network. However, one of the problems with the center fed sleeve antenna, is that the feed coaxial cable is "hot" and there is a slight mismatch to start with because the feed line is 50 ohms while the antenna is 70 ohms. Another problem of the sleeve antenna is that its major diameter of the sleeve is larger than what is often desirable. It is preferable to have a smaller diameter antenna, particularly when used with the relatively small transmitter/receivers in use today.

Therefore, it is desirable to provide an antenna that has a relatively small diameter. It is also desirable to provide an antenna that is well matched to the feed line. It is also desirable to provide an antenna that does not require a matching network within the internal circuitry of the transmitter/receiver.

I have discovered an antenna that is particularly useful in the cordless antenna range and the cellular antenna range, generally between about 800 MHz to 1000 MHz. Although no limitation is intended, the antenna of my invention is useful with respect to a convertible cordless/cellular phone of the type in which the transmitter/receiver is used as a cordless phone when it is within the range of the base station and is used as a cellular phone when it is out of range of the base station. The antenna of my invention has particular utility as a result of its rotatability, whereby the radiator can rotate about an axis that is generally perpendicular to the radiator.

It is an object of the present invention to provide an antenna that has a relatively small diameter.

It is another object of the present invention to provide an antenna that is well matched to the feed line.

A further object of the present invention is to provide an antenna that does not require a matching network within the internal circuitry of the transmitter/receiver.

A still further object of the present invention is to provide an antenna in which the radiator is rotatable about an axis that is generally perpendicular to the radiator.

A still further object of the present invention is to provide an antenna that is useful in the cordless telephone and cellular telephone bandwidth.

Other objects and advantages of the present invention will become apparent as the description proceeds.

SUMMARY OF THE INVENTION

In accordance with the present invention, a rotatable antenna is provided which comprises a radiator having a distal end and a proximal end. A matching network is coupled to the proximal end of the radiator. The matching network comprises a coil that extends generally perpendicular to the radiator. An electrically conductive sleeve overlies the coil and a transmission line is coupled to the electrically conductive sleeve and the coil. The transmission line comprises a main conductor and a ground conductor. The main conductor of the transmission line is tapped to the coil and the ground conductor of the transmission line is electrically connected to the sleeve. In this manner, the matching network substantially matches the radiator impedance to the transmission line impedance.

A mounting member is provided for mounting the antenna to a transmitter/receiver. The matching network is rotatable with respect to the mounting member whereby the radiator is rotatable about an axis that is generally perpendicular to the radiator.

In the illustrative embodiment, the transmission line is a 50 ohm coaxial cable.

In the illustrative embodiment, the antenna includes a plastic radiator housing, with the radiator housing defining a bore for receiving the radiator. The radiator and matching network comprise a contiguous electrically conductive spring wire.

In the illustrative embodiment, a non-conductive sleeve separates the matching network from the electrically conductive sleeve. A small coil is contiguous with the first mentioned coil, with the electrically conductive sleeve having a smaller sleeve portion for receiving the small coil. The ground conductor, small coil and the smaller sleeve portion are electrically connected to each other.

In the illustrative embodiment, the rotatable antenna has a radiator that is a one-half wavelength element suitable for a bandwidth between about 800 MHz and 1000 MHz.

A more detailed explanation of the invention is provided in the following description and claims, and is illustrated in the accompanying drawings.

BRIEF DESCRIPTION OF THE DRAWINGS

FIG. 3 is an exploded view of an antenna constructed in accordance with the principles of the present invention.

FIG. 4 is a diagrammatic view of the coaxial cable tapped to the matching network of an antenna constructed in accordance with the principles of the present invention.

FIG. 5 is a diagrammatic view of the electrical equivalent of a coaxial cable tapped to the matching network of an antenna constructed in accordance with the principles of the present invention.

FIG. 6 is a diagrammatic view of the antenna connection to a receiver/transmitter cabinet portion.

DETAILED DESCRIPTION OF THE ILLUSTRATIVE EMBODIMENT

Figure 1:
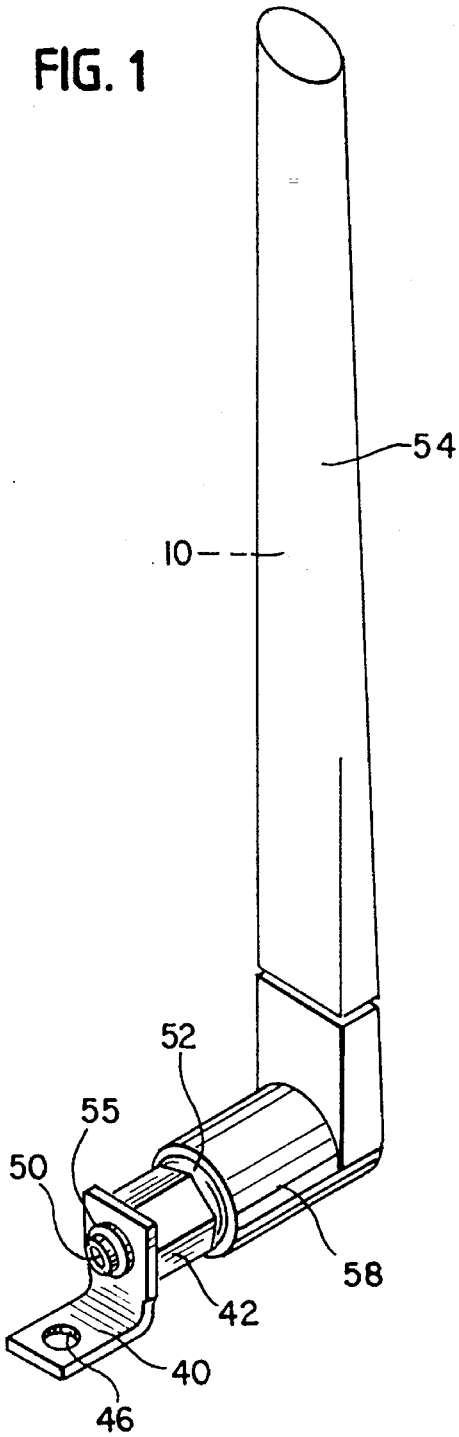
FIG. 1 is a perspective view of an antenna constructed in accordance with the principles of the present invention.
Figure 2:
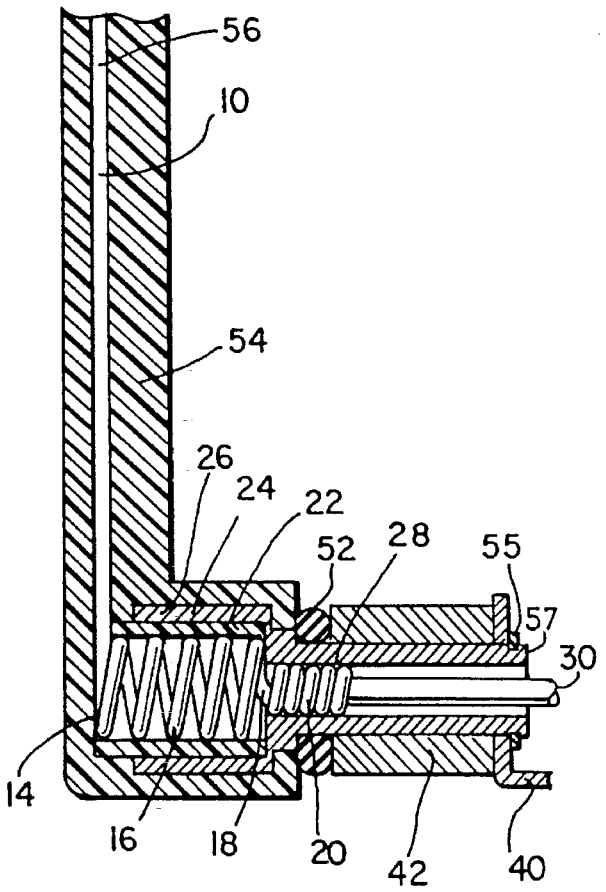
FIG. 2 is a cross-sectional elevation of an antenna constructed in accordance with the principles of the present invention.

Referring to the drawings, an antenna constructed in accordance with the present invention comprises a radiator 10 having a distal end 12 and a proximal end 14 and preferably formed of metal spring wire such as copper spring wire. Radiator 10 is preferably a one-half wavelength element which, in the illustrative embodiment utilized in the cordless and cellular frequency band, is approximately 6 inches in length.

A matching network coil 16 is contiguous with radiator 10, with the distal end of coil 16 being the proximal end 14 of radiator 10 and with the proximal end 18 of coil 16 being contiguous with a much smaller coil 20 utilized as a connection element. Since coil 16 is contiguous with radiator 10 and coil 20 is contiguous with coil 16, the unitary structure comprising radiator 10, coil 16 and coil 20 is formed of the same metal spring wire for efficiency in manufacturing. In the illustrative embodiment, coil 16 is one-half inch in length, one-quarter inch in diameter and 5 turns. The wire utilized for radiator 10, coil 16 and coil 20 is an 18 gauge copper spring wire, although no specific limitation is intended.

A plastic sleeve insulator 22, preferably in the form of a Teflon spacer, surrounds coil 16. Hexagonal brass bushing or sleeve 24 surrounds insulator 22 and smaller coil 20. Brass bushing 24 comprises a distal portion 26 that has a diameter sufficient to overlie Teflon insulator 22 and also a proximal portion 28 having an inner bore that is of a diameter sufficient to surround small coil 20.

A 50 ohm coaxial cable 30, comprising a main, center conductor 32, an insulator 34, a braid 36 and outer insulating cover 38, is provided for connecting the antenna to a transmitter/receiver. As illustrated in FIGS. 4 and 5, main conductor 32 is tapped to coil 16 at an appropriate place for matching the radiator to the transmission line. As illustrated in FIG. 4, braid 36 is fastened to small coil 20 which is conductively connected to proximal portion 28 of brass bushing 24.

Small coil 20 does not form a part of the matching network but instead is utilized as an effective element for connecting braid 36 to brass bushing 26. It is understood that other suitable connecting means could be utilized if desired.

Radiator 10 is rotatable about an axis that is perpendicular to the radiator, with the axis being coaxial with coil 16. To enable this rotation with respect to a transmitter/receiver to which radiator 10 is connected, a bracket 40 and a fixed sleeve 42 are utilized for coupling the radiator to the transmitter/receiver 44 (see FIG. 6). Bracket 40 and sleeve 42 may be formed of metal or plastic and/or may be combined as one piece. Bracket 40 has a generally L-shape, and defines one or more openings 46 to which a suitable fastening member 48 can be utilized for fastening the bracket 40 to the transmitter/receiver 44. Bracket 40 also defines an opening 50 for receiving proximal portion 28 of bushing 24. Proximal portion 28 is journaled within opening 50 and the bore 51 of fixed sleeve 42, thereby allowing the radiator 10 to rotate with respect to fixed sleeve 42 and bracket 40. An O-ring 52 is provided between fixed sleeve 42 and housing 54. O-ring 52 is compressed sufficiently to provide proper friction so that when the antenna is rotated to a desired position, it will retain that position. A spacer 55 aids to maintain the connection between bracket 40 and the proximal end 57 of sleeve portion 28, and to aid in providing the desired compression of O-ring 52.

Housing 54 is formed of plastic and defines a bore 56 for receiving radiator 10. The bottom portion 58 of housing 54 is sectioned (see FIG. 3) to receive the matching network 16 and brass bushing 24. It may be desirable to provide a stop in order for the antenna to be prevented from rotating more than 180°.

It can be seen that a radiator has been provided that is a half-wave end-fed element. There is no ground plane or counterpoise required. The coaxial cable 30 feeds the matching network and the matching network feeds the radiator. Because the matching network is not coaxial with the radiator, the radiator portion of the antenna has a relatively small diameter and is rotatable about an axis that is generally perpendicular to the radiator axis.

Although an illustrative embodiment of the invention has been shown and described, it is to be understood that various modifications and substitutions may be made by those skilled in the art without departing from the novel spirit and scope of the present invention.

I claim:

1. A rotatable antenna, which comprises:

a radiator having a distal end and a proximal end;

a matching network coupled to said proximal end of said radiator;

said matching network comprising a coil extending generally perpendicular to said radiator;

an electrically conductive sleeve overlying said coil;

a transmission line coupled to said electrically conductive sleeve and coil;

said transmission line comprising a main conductor and a ground conductor;

said main conductor being tapped to said coil and said ground conductor being electrically connected to said sleeve, whereby said matching network substantially matches the impedance of said radiator to the impedance of said transmission line;

a mounting member;

said matching network being rotatable with respect to said mounting member whereby said radiator is rotatable about an axis generally perpendicular to said radiator.

2. A rotatable antenna as defined by claim 1, in which said transmission line is a 50 ohm coaxial cable.

3. A rotatable antenna as defined by claim 1, including a plastic radiator housing, said radiator housing defining a bore for receiving said radiator.

4. A rotatable antenna as defined by claim 1, in which said radiator and matching network comprise a contiguous electrically conductive wire.

5. A rotatable antenna as defined by claim 1, including a non-conductive sleeve separating said matching network from said electrically conductive sleeve.

6. A rotatable antenna as defined by claim 1, in which said tapped coil is contiguous with said radiator and including a small coil, contiguous with said tapped coil, coupled to said tapped coil, said electrically conductive sleeve having a smaller sleeve portion for receiving said small coil; said ground conductor, said small coil and said smaller sleeve being electrically connected to each other.

7. A rotatable antenna as defined by claim 1, in which said radiator is a one-half wavelength element suitable for a bandwidth between about 800 MHz and 1,000 MHz.

8. A rotatable antenna, which comprises:

a radiator having a distal end and a proximal end;

a plastic radiator housing, said radiator housing defining a bore receiving said radiator;

a matching network coupled to said proximal end of said radiator;

said matching network comprising a coil extending generally perpendicular to said radiator, said radiator and said coil comprising a contiguous electrically conductive wire;

an electrically conductive sleeve overlying said coil;

a non-conductive sleeve separating said coil from said electrically conductive sleeve;

a transmission line coupled to said electrically conductive sleeve and coil;

said transmission line comprising a main conductor and a ground conductor;

said main conductor being tapped to said coil and said ground conductor being electrically connected to said sleeve, whereby said matching network substantially matches the impedance of said radiator to the impedance of said transmission line;

a mounting member coupled to said matching network;

said matching network being rotatable with respect to said mounting member whereby said radiator is rotatable about an axis generally perpendicular to said radiator.

9. A rotatable antenna as defined by claim 8, in which said transmission line is a 50 ohm coaxial cable.

10. A rotatable antenna as defined by claim 8, including a small coil, contiguous with said tapped coil, coupled to said tapped coil, said electrically conductive sleeve having a smaller sleeve portion for receiving said small coil; said ground conductor, said small coil and said smaller sleeve portion being electrically connected to each other.

11. A rotatable antenna as defined by claim 8, in which said radiator is a one-half wavelength element suitable for a bandwidth between about 800 MHz and 1000 MHz.

* * * * *